United States Patent [19]

Mullins et al.

[11] Patent Number: 4,459,153

[45] Date of Patent: Jul. 10, 1984

[54] PYROCHEMICAL PROCESS FOR EXTRACTING PLUTONIUM FROM AN ELECTROLYTE SALT

[75] Inventors: Lawrence J. Mullins; Dana C. Christensen, both of Los Alamos, N. Mex.

[73] Assignee: The United States of America as represented by the United States Department of Energy, Washington, D.C.

[21] Appl. No.: 420,432

[22] Filed: Sep. 20, 1982

[51] Int. Cl.[3] ..... B22C 3/00

[52] U.S. Cl. ..... 75/84.1 R

[58] Field of Search ..... 75/84.1

[56] References Cited

U.S. PATENT DOCUMENTS

| | | | |
|---|---|---|---|
| 2,890,110 | 6/1959 | Baker | 75/84.1 |
| 2,899,298 | 8/1959 | Anicetti | 75/84.1 |
| 3,049,423 | 8/1962 | Reavis et al. | 75/84.1 R |
| 3,666,442 | 5/1972 | Conner | 75/84.1 |

OTHER PUBLICATIONS

Mullins et al., "Fused Salt Processing of Impure Plutonium Dioxide to High-Purity Plutonium Metal," LA-9154-MS UC-10, Jan. 1982.

Mullins et al., "A Review of Operating Experience at the Los Alamos Plutonium Electrorefining Facility, 1963-1977," LA-8943, Dec. 1981.

*Primary Examiner*—Brooks H. Hunt

*Attorney, Agent, or Firm*—William A. Eklund; Paul D. Gaetjens; Michael F. Esposito

[57] ABSTRACT

A pyrochemical process for extracting plutonium from a plutonium-bearing salt is disclosed. The process is particularly useful in the recovery of plutonium from electrolyte salts which are left over from the electrorefining of plutonium. In accordance with the process, the plutonium-bearing salt is melted and mixed with metallic calcium. The calcium reduces ionized plutonium in the salt to plutonium metal, and also causes metallic plutonium in the salt, which is typically present as finely dispersed metallic shot, to coalesce. The reduced and coalesced plutonium separates out on the bottom of the reaction vessel as a separate metallic phase which is readily separable from the overlying salt upon cooling of the mixture. Yields of plutonium are typically on the order of 95%. The stripped salt is virtually free of plutonium and may be discarded to low-level waste storage.

4 Claims, No Drawings

PYROCHEMICAL PROCESS FOR EXTRACTING PLUTONIUM FROM AN ELECTROLYTE SALT

BACKGROUND OF THE INVENTION

The present invention is generally related to the refining and purification of plutonium. This invention is the result of a contract with the Department of Energy (Contract No. W-7405-ENG-36).

For a number of years a process known as molten salt electrorefining has been the primary process for producing high-purity plutonium from plutonium-bearing scrap metal. This process is ordinarily conducted in an electrorefining cell that consists of a small magnesia crucible nested inside a large magnesia crucible. A charge of plutonium-bearing scrap metal is placed in the small crucible. The large crucible is then filled with a salt electrolyte consisting of equimolar NaCl and KCl, covering the small crucible and its charge, and the cell is heated until both the metal charge and the salt electrolyte are molten. The molten metal, being denser than the salt, remains in the small crucible as a separate metallic phase beneath the molten salt.

An electrical anode is then introduced into the molten scrap metal charge in the small crucible, and a tubular electrical cathode is suspended in the molten salt electrolyte around the small crucible. During the refining operation a dc current is passed between the electrodes, causing plutonium in the scrap metal to oxidize to $Pu^{+3}$ at the anode. The molten salt is stirred to facilitate migration of the $Pu^{+3}$ through the salt to the cathode, where it is reduced back to the metal. The reduced plutonium metal drips off the cathode and collects in a molten ring at the bottom of the large crucible, around the base of the small crucible. When the process is completed, the cell is cooled and the solid ring of purified plutonium is mechanically separated from the overlying salt cake and the scrap metal residue remaining in the small crucible.

A more complete description of the electrorefining cell and its use is set forth in U.S. Pat. No. 3,098,028 to Mullins et al., and in U.S. Pat. Nos. 3,281,338 and 3,417,002 to Leary et al., which are hereby incorporated by reference.

The salt cake left over from the electrorefining process contains a considerable amount of residual plutonium. A typical salt cake weighs 2.5 kg and contains approximately 0.5 kg plutonium. This plutonium is present in the salt in two forms; as finely dispersed metallic beads or shot, and as dissolved plutonium chloride or fluoride. Recovery of this plutonium has previously been accomplished by a rather tedious series of aqueous processing steps which take about a week and which generate large volumes of secondary plutonium-bearing liquid residues that must be permanently stored or reprocessed.

SUMMARY OF THE INVENTION

Accordingly, it is the object of the present invention to provide an improved method of extracting plutonium from electrorefining salts.

It is also an object to provide such a method which is substantially quantitative, and which extracts plutonium that may be present in the salt in the form of dispersed metallic shot as well as dissolved plutonium salts.

It is another object to provide a method that achieves the foregoing objects and which extracts the plutonium directly in the form of plutonium metal suitable for recycling as scrap metal feed in the electrorefining process.

It is a further object to provide a method for extracting plutonium from electrolyte salts that is fast and which does not generate large amounts of secondary plutonium-bearing residues.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the methods particularly pointed out in the appended claims.

To achieve the foregoing and other objects, and in accordance with the purpose of the present invention, as embodied and broadly described herein, the method of the present invention comprises the mixing of a plutonium-bearing salt with metallic calcium under molten conditions. The calcium reduces ionized plutonium in the molten salt to plutonium metal. Additionally, the calcium causes dispersed metallic plutonium in the salt to coalesce lesce and separate outs as a separate metallic phase. This latter aspect of the process was unexpected when discovered and is still not well understood. It is however a welcome discovery, as there has not been previously known any way to effectively remove the dispersed metallic plutonium from the molten salt.

The reduced and coalesced plutonium settles to the bottom of the reaction vessel as a separate metallic phase which can be mechanically separated from the overlying salt after the mixture is cooled.

The metallic plutonium phase is usually surrounded by a layer of poorly characterized black plutonium-bearing salts. Together these black salts and the metallic plutonium account for virtually all of the plutonium originally present in the salt. More specifically, approximately 95% of the plutonium originally present in the salt is extracted as the metal and approximately 5% is extracted in the form of the black salts. The recovered plutonium metal is directly recyclable as scrap feed in the electrorefining process, and the black salts can be accumulated and reprocessed in subsequent salt extraction runs. The stripped salt is sufficiently free of plutonium as to make further plutonium recovery unnecessary and to permit the salt to be discarded to low-level waste storage.

These and other aspects of the invention are more fully set forth in the following detailed description of the preferred embodiment.

DETAILED DESCRIPTION OF THE INVENTION

In accordance with the preferred embodiment of the method of the present invention, a plutonium-bearing salt cake is loaded into a vitreous magnesia crucible and mixed with pelletized calcium metal. The relative amounts of calcium and salt are determined by the plutonium content of the salt, which can be readily determined by segmented gamma scanning. A suitable range of proportions consists of approximately 30 to 350 gms of calcium per kilogram of plutonium contained in the salt. In a typical run approximately 45 gms of calcium are used in the extraction of a salt cake weighing about 2.5 kg and containing on the order of 0.5 kg plutonium.

The loaded crucible is heated under an inert atmosphere at a maximum rate of 200° C./hr to approximately 800° C. At this temperature the salt is molten but the calcium is still solid. The solid calcium is immiscible in the salt and floats on its surface. The molten salt is stirred and its temperature monitored with a thermocouple. The reduction reaction is usually complete in less than 5 minutes; however, stirring is continued for about 15 minutes to ensure complete coalescence of the metallic plutonium. If the salt contains a relatively large amount of $PuCl_3$ an immediate increase in the temperature of the mixture is observed in the first few minutes as a result of the exothermic reduction of $Pu^{+3}$.

Upon completion of the reaction the mixture is cooled and the crucible is broken to remove the solid contents. At the bottom of the crucible the reduced and coalesced plutonium is found as a metallic button which constitutes approximately 95% of the plutonium originally present in the salt. Most of the remaining plutonium (~5%) occurs as a layer of black plutonium-bearing salts around the plutonium button. The overlying salt is substantially free of plutonium and need not be subjected to further plutonium recovery.

The black salts which account for approximately 5% of the recovered plutonium have been preliminarily determined to consist primarily of a NaCl—KCl salt matrix containing crystals of $CaF_2$, $CaCl_2$ and CaO and small metallic particles of plutonium.

The only impurities that will accumulate in the salt during the electrorefining process are the alkali metals, the alkaline earths, the rare earths, and americium. Of these, only americium is a common metallic impurity in the electrorefining feed metal. Thus, in principle, plutonium metal derived from the extraction of electrorefining salts should be fairly pure, containing only americium and calcium as impurities. In practice, however, small pieces of both depleted anode and magnesia crucible accompany the salt in the extraction process, so that magnesium and anode impurities are also present in the plutonium product.

The metallic plutonium button may be recycled directly as scrap feed for the electrorefining process. The black salts may be accumulated over several runs and eventually reprocessed. Such reprocessing may be accomplished by mixing the black salts with a $CaCl_2$ salt diluent to produce a salt cake that may be stripped by the calcium reduction/coalescence process described above.

EXAMPLE 1

In an actual demonstration of the process, approximately 3.2 kg of plutonium-bearing NaCl—KCl salt from an electrorefining run were loaded into a magnesia crucible. The salt was determined by segmented gamma scanning to contain 903 gm plutonium. Forty five grams of pelletized calcium were added to the crucible. The loaded crucible was placed in a stainless steel loading can. This assembly was placed in a sealed, resistance heated furnace tube. The furnace tube was evacuated and then filled with argon to a pressure of 4 psig.

The crucible was heated at a rate of 200° C./hr to 800° C., at which time a thermocouple and a tantalum stirrer were introduced into the melt. The stirrer was fitted with opposing upper and lower impellers, with the lower impeller operating to drive the molten salt upward and the upper impeller operating to drive the calcium downward. The thermocouple was a standard chromel-alumel thermocouple protected by a tantalum-nickel sheath.

Stirring was initiated and slowly increased to 600 rpm over a one minute period. After stirring for 15 minutes the stirrer and thermocouple were removed from the melt and the furnace was turned off. The furnace was allowed to cool for about 4 hours, after which the magnesia crucible was withdrawn and broken to remove its contents. At the bottom of the crucible was formed a metallic plutonium button. Between the plutonium button and the overlying white salt cake was a layer of black plutonium-bearing salt. Unconsumed calcium was present as small solid beads on the top of the salt cake.

The results of this run are summarized in Table I, set forth below:

TABLE I

| | Bulk wt. (g) (% of bulk) | Pu Content (g) (% of Pu) |
|---|---|---|
| Feed | | |
| Salt | 3215 | 903 (100%) |
| Calcium | 45 | — |
| Product | | |
| Salt | 1980 (61%) | 0.0 (0%) |
| Black Salts | 385 (12%) | 38.5 (4.3%) |
| Crucible | — | 0.7 (0.1%) |
| Pu Button | 895 (27%) | 863.0 (95.6%) |

As indicated above, virtually all of the plutonium was extracted from the salt cake, and only a minor amount (0.1%) remained with the crucible material. Approximately 95.6% of the plutonium was recovered as the metallic button, which is suitable for direct purification by the electrorefining process. It is noted that this one-day, one-step recovery of over 95% of the plutonium in the form of a metal button replaces a wet chemical process which previously took a week and required multiple process steps, all of which generated substantial volumes of secondary plutonium-bearing residues which had to be permanently stored and/or reprocessed.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of extracting plutonium from an electrolyte salt containing dispersed particles of plutonium metal, comprising the steps of:

forming a mixture of said electrolyte salt with metallic calcium in a reaction vessel;

heating said mixture until said salt is molten, and stirring the molten salt to effect reduction and coalescence of plutonium in said salt to a separate molten metallic plutonium phase; and cooling said mixture and mechanically separating said metallic plutonium phase from said salt.

2. The method of claim 1 wherein the amount of calcium is between approximately 30 and 350 grams of calcium per kilogram of plutonium contained in said salt.

3. The method of claim 2 wherein the amount of calcium is on the order of 90 grams of calcium per kilogram of plutonium contained in said salt.

4. The method of claim 1 wherein said salt and said calcium are heated to a temperature at which said salt is molten and said calcium is solid.

* * * * *